US011566756B2

(12) United States Patent
Ford

(10) Patent No.: US 11,566,756 B2
(45) Date of Patent: Jan. 31, 2023

(54) FLEXIBLE SIGNALING DEVICE

(71) Applicant: 9609385 CANADA INC., Beaconsfield (CA)

(72) Inventor: Timothy D. F. Ford, Beaconsfield (CA)

(73) Assignee: 9609385 CANADA INC., Beaconsfield (CA)

( * ) Notice: Subject to any disclaimer, the term of this patent is extended or adjusted under 35 U.S.C. 154(b) by 0 days.

(21) Appl. No.: 17/806,784

(22) Filed: Jun. 14, 2022

(65) Prior Publication Data

US 2022/0397245 A1 Dec. 15, 2022

Related U.S. Application Data

(60) Provisional application No. 63/202,484, filed on Jun. 14, 2021.

(51) Int. Cl.

| | |
|---|---|
| ***F21L 4/00*** | (2006.01) |
| ***F21L 4/08*** | (2006.01) |
| ***F21V 23/06*** | (2006.01) |
| ***F21V 5/00*** | (2018.01) |
| *F21Y 115/10* | (2016.01) |

(52) U.S. Cl.

CPC ..... *F21L 4/005* (2013.01); *F21L 4/085* (2013.01); *F21V 5/00* (2013.01); *F21V 23/06* (2013.01); *F21Y 2115/10* (2016.08)

(58) Field of Classification Search

CPC ..... F21L 4/005; F21L 4/085

See application file for complete search history.

(56) References Cited

U.S. PATENT DOCUMENTS

| | | | | |
|---|---|---|---|---|
| 6,394,621 | B1 * | 5/2002 | Hanewinkel, III | F21L 4/005 362/203 |
| 8,733,989 | B1 * | 5/2014 | Lo | F21V 23/0414 362/475 |
| 2003/0090899 | A1 * | 5/2003 | Galli | F21V 23/0414 362/200 |
| 2014/0355260 | A1 * | 12/2014 | Ford | F21L 4/027 362/183 |
| 2018/0216808 | A1 * | 8/2018 | Ford | F21V 5/006 |

* cited by examiner

*Primary Examiner* — Evan P Dzierzynski

(74) *Attorney, Agent, or Firm* — Lavery, De Billy, LLP; Hugh Mansfield

(57) ABSTRACT

A signaling device is disclosed comprising an electronic circuit positioned within a housing and comprising at least one LED, a light diffuser manufactured from a non-opaque material and a USB Port. Side edges of the housing each comprise a barb engaging slot therein. A cap end covering the USB port and comprising a pair of flexible fingers each comprising a barb-like feature for engaging respective ones of the barb engaging slots comprises an actuating part fabricated from a compressible rubberlike material which is secured towards a second end of each of the flexible fingers. Compressing the actuating part motivates the outer ends of the flexible fingers to move apart, thereby releasing the barb-like features from their respective barb engaging slot and allowing the cap to be removed from the housing.

7 Claims, 6 Drawing Sheets

FLEXIBLE SIGNALING DEVICE

CROSS REFERENCE TO RELATED APPLICATIONS

This application claims benefit of U.S. provisional application Ser. No. 63/202,484 filed on Jun. 14, 2021. All documents above are incorporated herein in their entirely by reference.

FIELD OF THE INVENTION

The present invention relates to a flexible signaling device.

SUMMARY OF THE INVENTION

There is provided a signaling device comprising a housing manufactured from a rigid material, an electronic circuit positioned within the housing and comprising at least one LED arranged along a light emitting edge of the housing, a battery, a user actuatable switch for selectively energizing the at least one LED and a raised USB Port exposed on a USB edge of the housing, the USB edge and the light emitting edge interconnected by a pair of opposed side edges, each of the side edges comprising a barb engaging slot therein, a light diffuser arranged along the axis, the diffuser manufactured from a non-opaque material comprising a top and a light input edge positioned adjacent the light emitting edge, and a cap end comprising a pair of flexible fingers each comprising a barb-like feature toward a first outer end thereof on either side of an indent configured to snugly receive the USB port, each of the barb-like features engaged in a respective one of the barb engaging slots and an actuating part fabricated from a compressible rubberlike material and secured towards a second end of each of the flexible fingers. Compressing the actuating part motivates the outer ends of the flexible fingers to move apart, thereby releasing the barb-like features from their respective barb engaging slot.

DETAILED DESCRIPTION OF THE ILLUSTRATIVE EMBODIMENTS

Figure 1A:
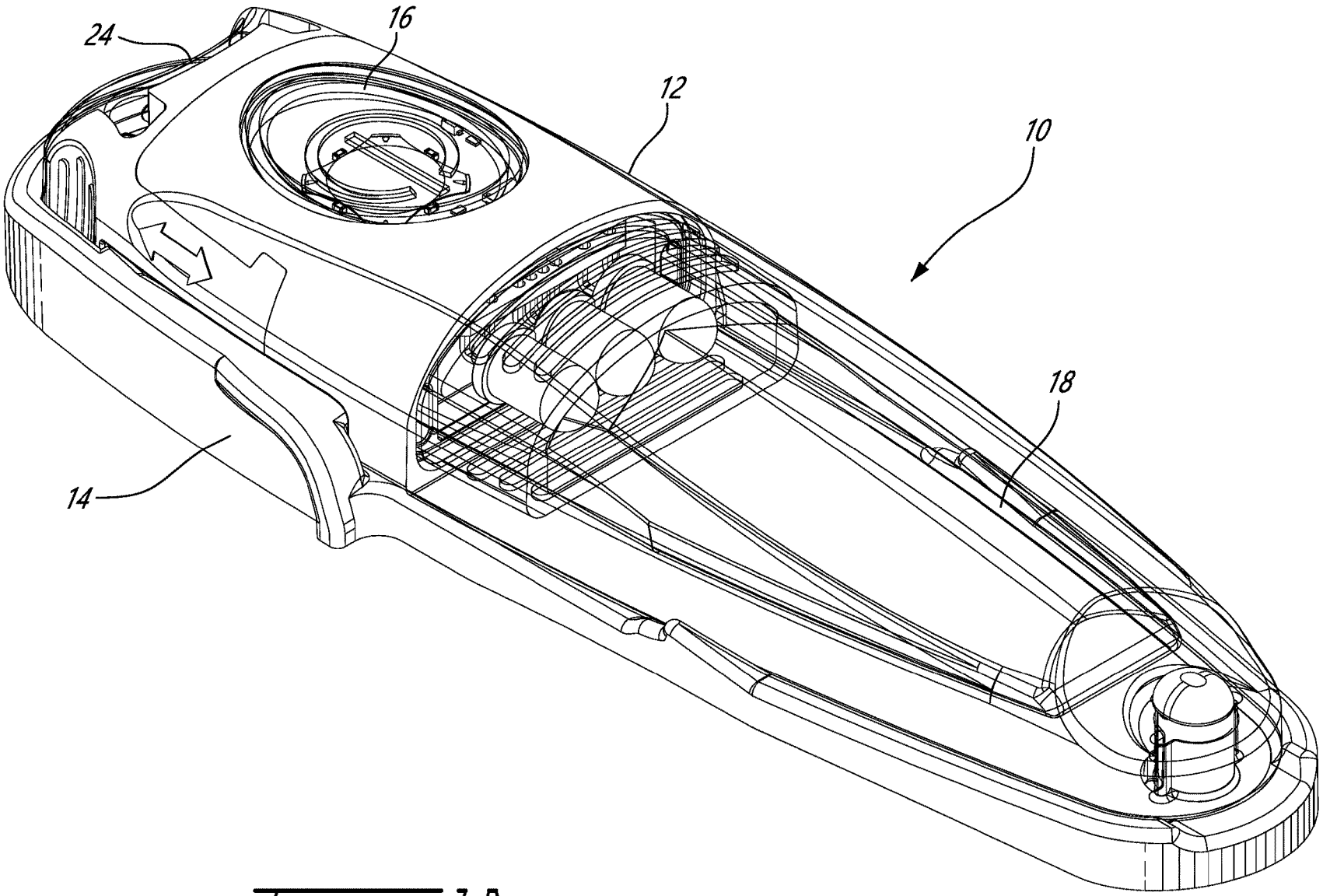
FIG. 1A provides a perspective view of a flexible signaling device assembly in accordance with an illustrative embodiment of the present invention.
Figure 1B:
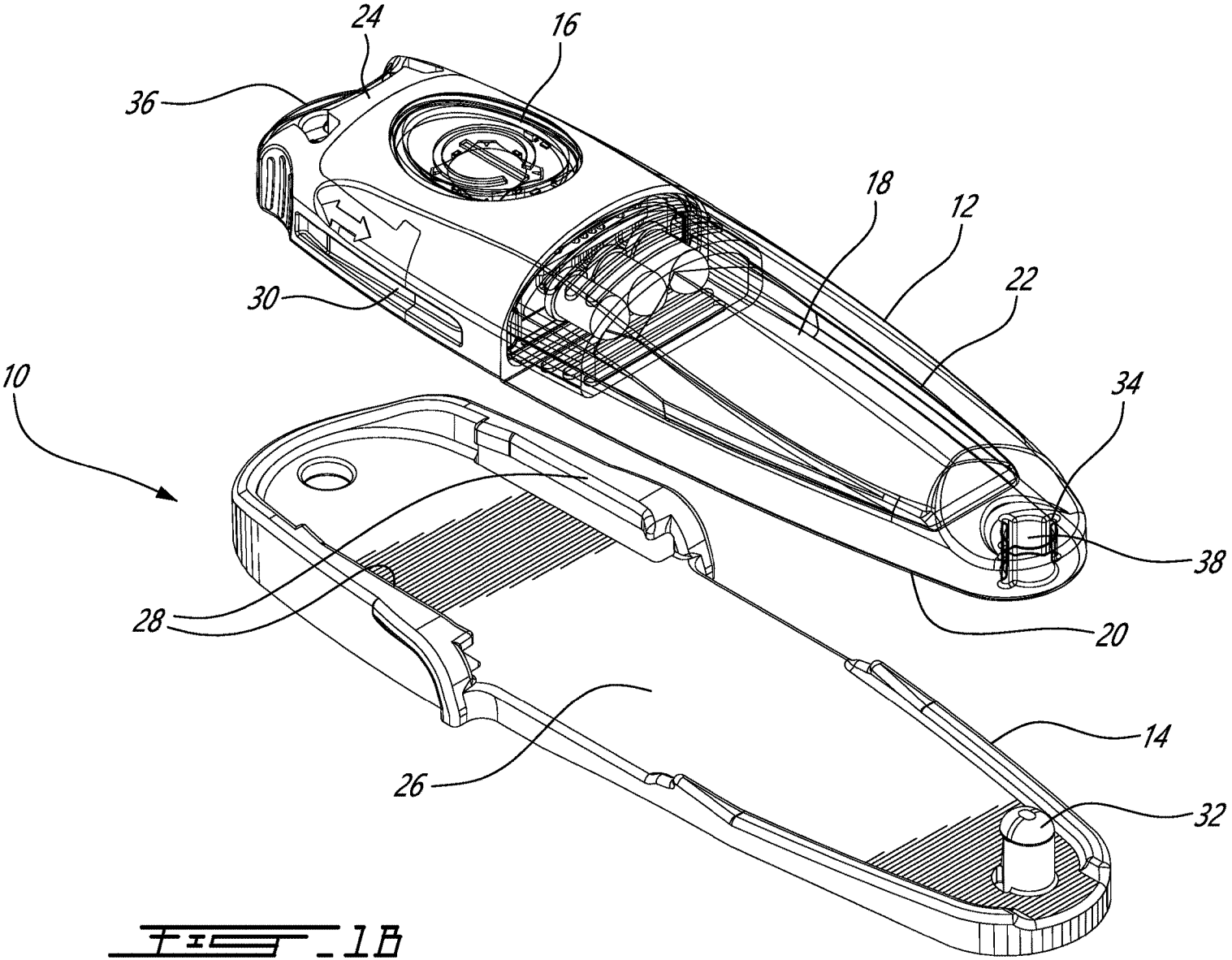
FIG. 1B provides an exploded view of the flexible signaling device assembly of FIG. 1A.

Referring now to FIGS. 1A and 1B, a flexible signaling device assembly generally referred to using the reference numeral 10, and in accordance with an illustrative embodiment of the present invention will now be described. The flexible signaling device assembly 10 comprises a flexible signaling device 12 which is receivable by an accessory attachment 14. The flexible signaling device 12 comprises a housing 16 manufactured from a rigid material such as plastic or the like, an elongate hollow light diffuser 18 manufactured from a non-opaque flexible rubberlike material such as suitable mixtures including translucent silicon or Santoprene or the like. The housing 16 and diffuser 18 combine to form a device having a flat bottom 20, a smoothly curved top 22 and a unitary elongate ellipsoid shape when viewed from above. The cap end 24 of the device 12 opposite the diffuser 18, is also in part manufactured from the same non-opaque flexible rubberlike material as the diffuser with the housing 16 sandwiched between the diffuser 18 and the cap end 24.

Still referring to FIGS. 1A and 1B, the accessory attachment 14 comprises one or more means for securing the device 10 to other objects, for example a toolless connector (not shown) such as magnet, Velcro or the like or an adhesive. The accessory attachment 14 comprises an upper surface 26 for receiving the flat bottom 20 of the device 12. The accessory attachment 14 is molded or otherwise formed from a rigid yet flexible material such as plastic or the like. The device 12 is securable to the accessory attachment 14 by aligning each of a pair guides 28 with respective ones of a pair slots 30 moulded on either side (only one shown) of the housing 12, and then sliding the guides 28 onto their respective slots 30 and the device 12 onto the accessory attachment 14. A button post 32 on the accessory attachment 14 is inserted into a corresponding aperture 34 in the device 12 thereby securing the device 12 to the accessory attachment 14. A person of ordinary skill in the art will now understand that, although the accessory attachment 14 might be rigid, the device 12 can be easily secured to the accessory attachment 14 due to its flexible nature.

Still referring to FIGS. 1A and 1B, the ends of the device 12 define fastener receiving apertures 34, 36, for example as discussed above for receiving the button post 32 provided on the accessory attachment 14, or a mounting plate or the like (not shown). Illustratively, the apertures 34, 36 comprise notches 38 to receive a keyed fastener, for example.

Figure 2:
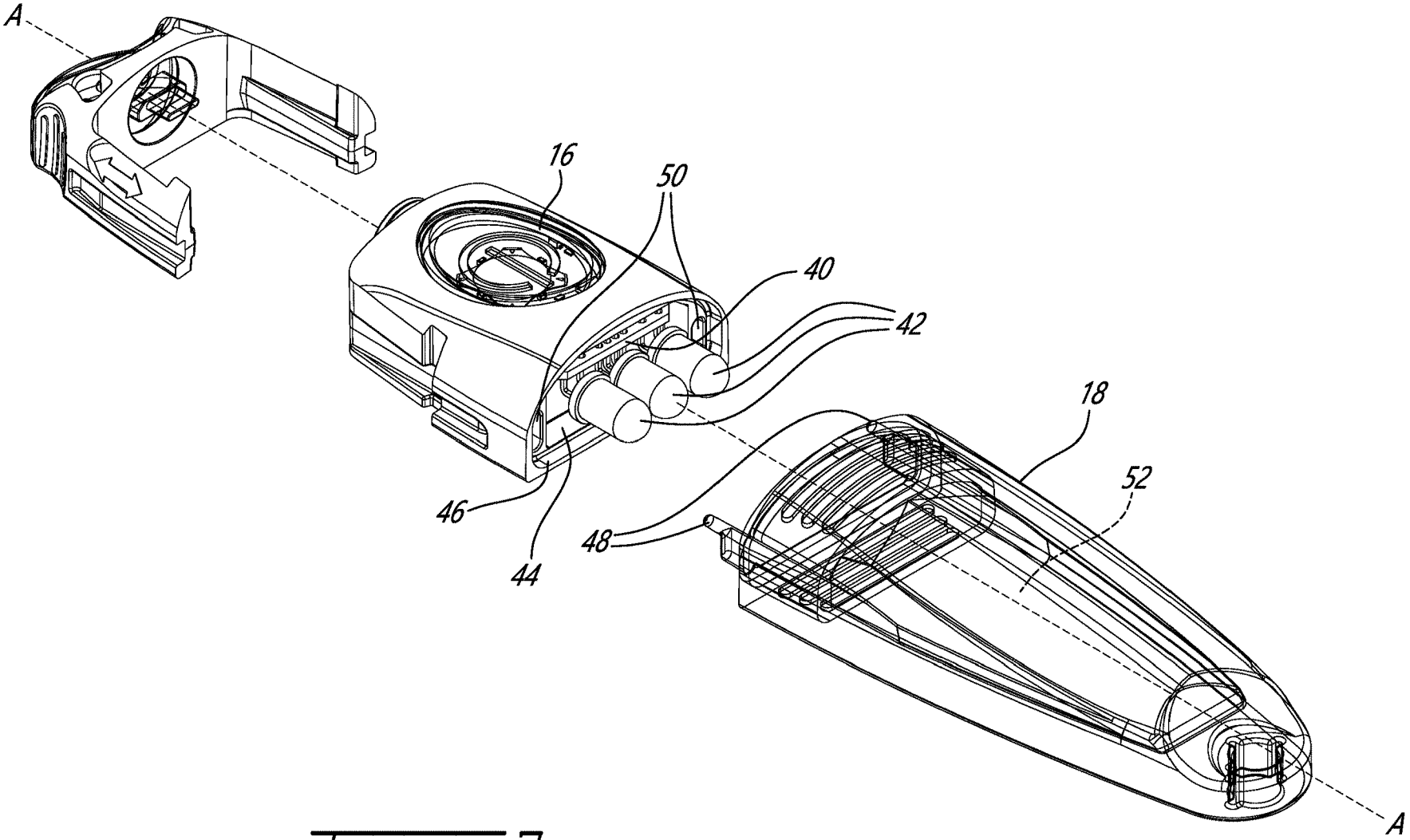
FIG. 2 provides an exploded perspective view of a flexible signaling device in accordance with an illustrative embodiment of the present invention.

Referring now to FIG. 2, the housing 16 houses an electronic circuit 40 comprising a plurality of LEDs 42 which are arranged along a light emitting edge 44 of the housing 16 to emit light generally in parallel to an axis A-A of the device. In a particular embodiment the beams of the outer LEDs 42 can be slightly angled such that all LEDs 42 they converge towards a point, for example at the extreme end of the diffuser 18. The housing 16 further comprises a lip 46 onto which the diffuser 18 can be inserted. A pair of retaining features 48 are also provided on the diffuser 18 which are engaged by a respective one of a pair of impressions 50 molded in the housing 16.

Still referring to FIG. 2, in a particular embodiment the non-opaque flexible rubberlike material used to fabricate the diffuser 18 is buoyant and such that the device 12 floats when placed in fresh or salt water. Alternatively, or additionally, the inside of the diffuser 18 may be fabricated such that a hollow chamber 52 is formed as shown, thereby increasing buoyancy. Additionally, the sides of the diffuser 18 can be made opaque and/or silvered on the inside and such that they reflect the light emitted by the LEDs 42 inwards such that more visible light is emitted via the upper surface of the diffuser 18.

Figure 3A:
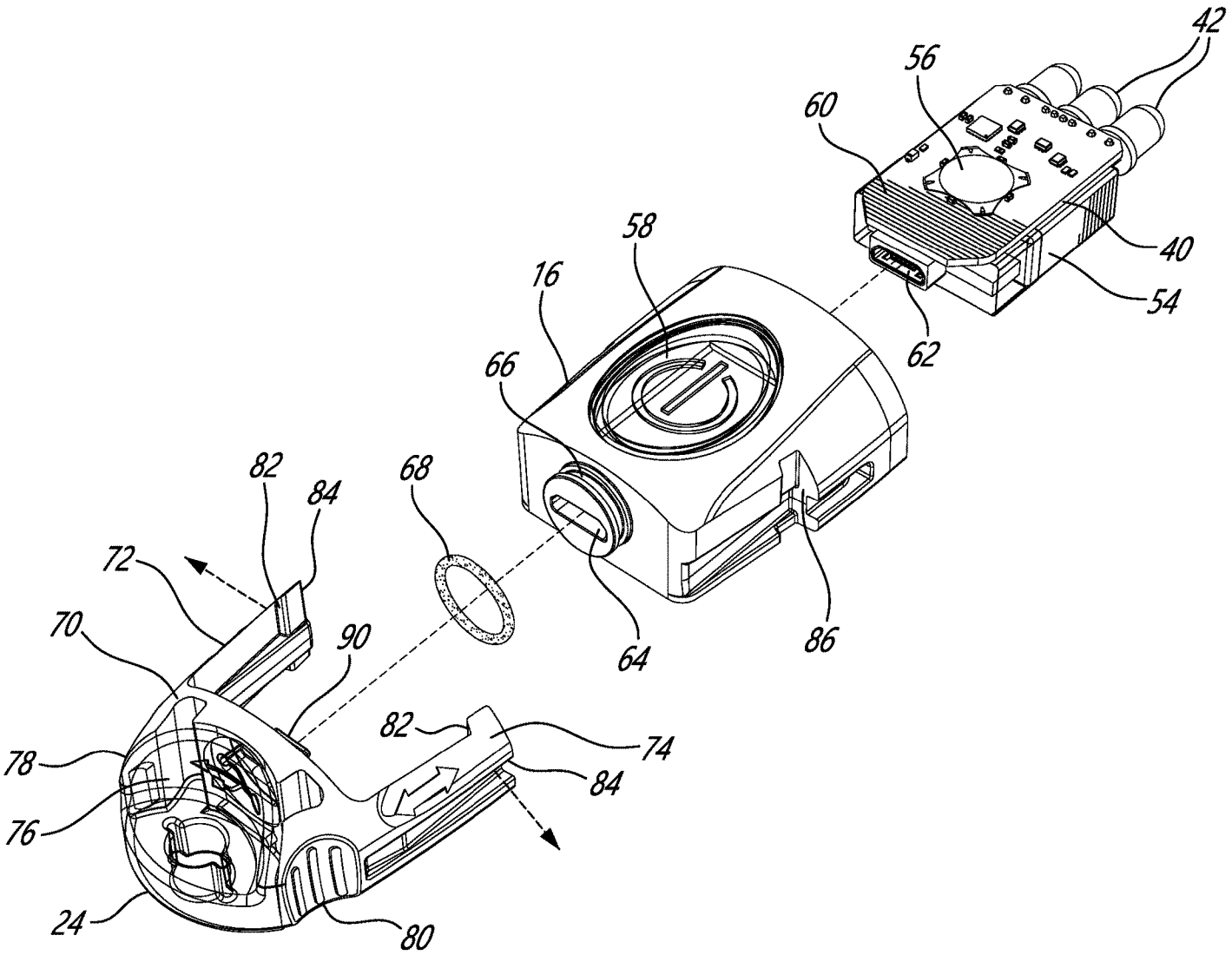
FIG. 3A provides an exploded view of a cap end and housing portion of a flexible signaling device in accordance with an illustrative embodiment of the present invention.

Referring to FIG. 3A, as discussed above, the electronic circuit 40 is held within the housing 16 and comprises, for example, a rechargeable battery 54, a switch 56 activated by a push button 58 and a Printed Circuit Board (PCB) 60 comprising traces (not shown) interconnecting the battery 54, switch 56 and the like with the LEDs 42. Additionally, a USB port 62 is provided, which provides power via a suitable adaptor (not shown), in particular to recharge the rechargeable battery 54. In a particular embodiment the USB port 62 may also be used to provide software updates and the like. When the electronic circuit 40 and battery 54 assembled into the housing 16 the USB port 62 is received within a raised feature 64 and can be accessed by removal of the cap end 24 of the device 12. The raised feature 64 comprises an outer circumferential groove 66 which is configured to snugly receive an O-ring 68.

Figure 3B:
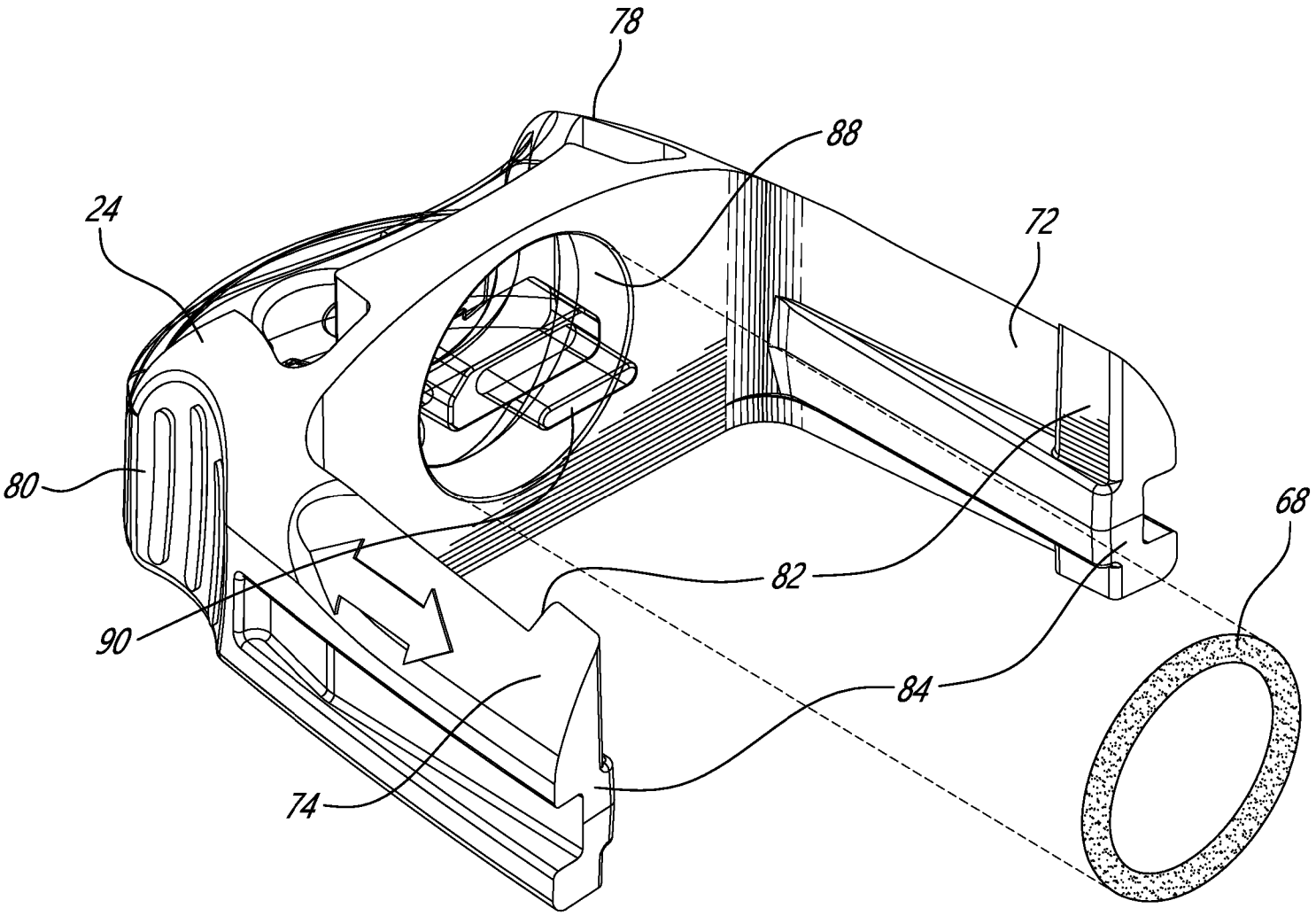
FIG. 3B provides a reversed perspective detailed view of the cap end of a flexible signaling device in accordance with an illustrative embodiment of the present invention.

As discussed above, and referring to FIG. 3B in addition to FIG. 3A, the cap end 24 comprises a rigid yet flexible first part 70 comprising a pair of flexible fingers 72, 74 together with a second actuating part 76 fabricated from a flexible rubberlike material such as suitable mixtures including translucent silicon or Santoprene or the like. A pair of opposed pads 78, 80 are molded in the second part 76 and the fingers 72, 74 each comprise a barb-like feature 82 towards an outer end 84 thereof. On insertion of the cap end 24 onto the housing 16 each barb-like feature 82 engages with complementary slot 86 in the housing 16 and are releasably held in place by the elastic nature of the actuating part 76. At the same time the O-ring 68 engages with an inner surface 88 of the first part providing a seal and the mouth of the USB Port 62 is plugged by a complementary "plug" 90 molded in the rubberlike material of the actuating part 76.

Referring back to FIG. 2, on insertion of the device 12 into the holder 14, as discussed above a pair guides 28 are slid into respective ones of a pair of slots 30 on either side of the housing 12, thereby preventing the fingers 72, 74 from being inadvertently forced apart.

Referring again to FIG. 3B in addition to FIG. 3A, as will now be understood by a person of ordinary skill int art, by gripping the opposed pair of pads 78, 80 between thumb and index finger and compressing the actuating part 76, the fingers 72, 74 can be motivated to move apart as indicated, thereby removing each barb-like feature 82 from its respective slot 86 and facilitating the removal of the cap end 24 from the housing.

Figure 4:
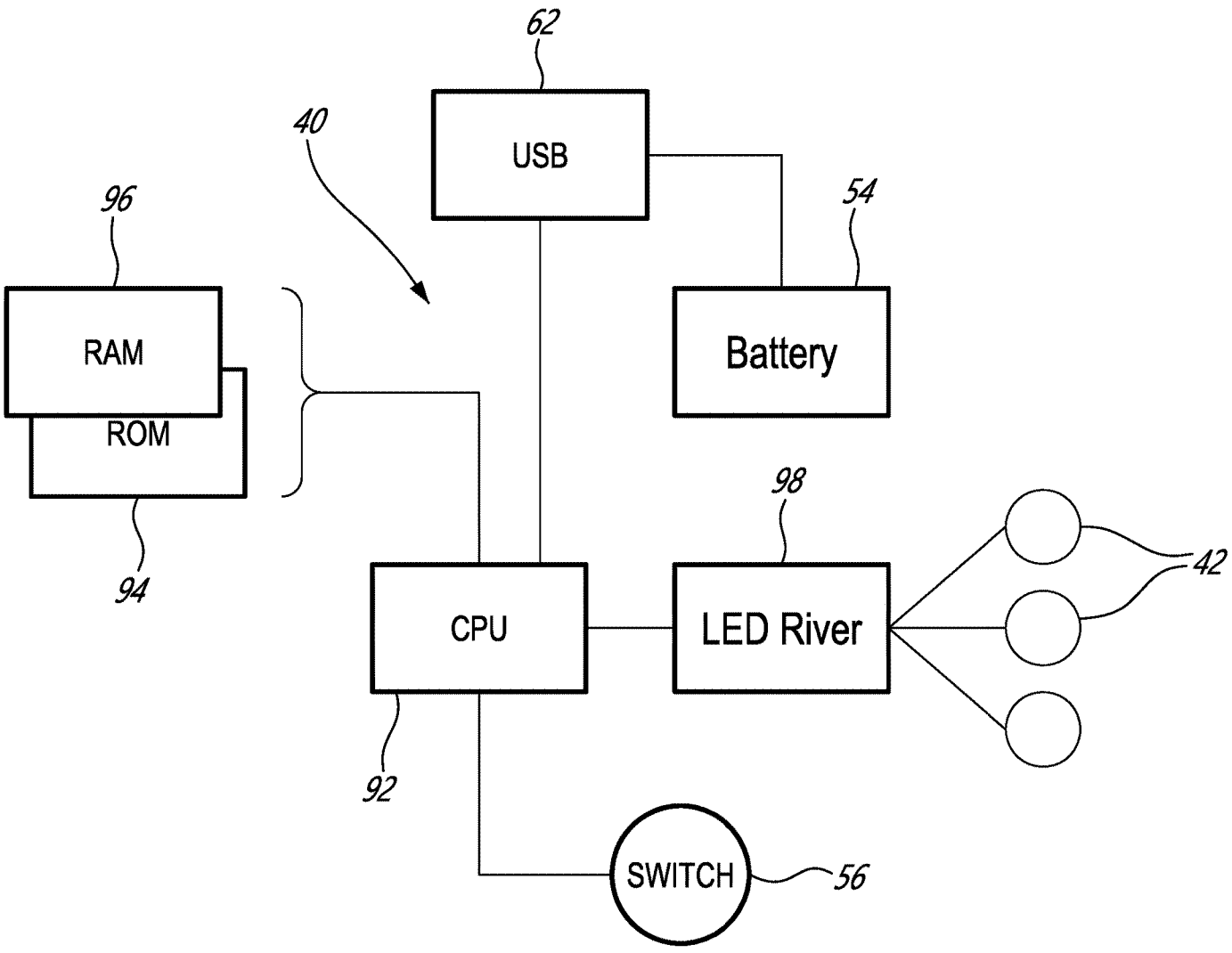
FIG. 4 provides a schematic diagram of an electronic circuit for use with a flexible signaling device and in accordance with a illustrative embodiment of the present invention.

Referring now to FIG. 4, although in an illustrative embodiment the rechargeable battery 54 simply provides power to the LEDs 42 under control of the switch 56, in a particular embodiment the electronic circuit 40 comprises additional components such as a CPU 92 which controls the one or more LEDs 42 using software and data stored in ROM 94 or RAM 96 and via an LED Driver 98 and updateable via the USB Port 62 to provide enhanced visual effects such as flashing or the like.

Although the present invention has been described hereinabove by way of specific embodiments thereof, it can be modified, without departing from the spirit and nature of the subject invention as defined in the claims.

I claim:

1. A signaling device comprising:

a housing manufactured from a rigid material;

an electronic circuit positioned within said housing and comprising at least one LED arranged along a light emitting edge of said housing, a battery, a user actuatable switch for selectively energizing said at least one LED and a raised USB Port exposed on a USB edge of said housing, said USB edge and said light emitting edge interconnected by a pair of opposed side edges, each of said side edges comprising a barb engaging slot therein;

a light diffuser arranged along said axis, said diffuser manufactured from a non-opaque material comprising a top and a light input edge positioned adjacent said light emitting edge; and a cap end comprising a pair of flexible fingers each comprising a barb-like feature toward a first outer end thereof on either side of an indent configured to snugly receive said USB port, each of said barb-like features engaged in a respective one of said barb engaging slots and an actuating part fabricated from a compressible rubberlike material and secured towards a second end of each of said flexible fingers;

wherein compressing said actuating part motivates said outer ends of said flexible fingers to move apart, thereby releasing said barb-like features from their respective barb engaging slot.

2. The signaling device of claim 1, wherein said housing comprises a rounded top.

3. The signaling device of claim 1, further comprising a plurality of said at least one LEDs arranged side by side along said light emitting edge of said housing.

4. The signaling device of claim 1, wherein said diffuser is elongate.

5. The signaling device of claim 1, wherein said diffuser is manufactured from a flexible rubberlike material.

6. The signaling device of claim 1, wherein said diffuser is translucent.

7. The signaling device of claim 1, wherein said diffuser comprises a rounded top.

* * * * *